US008893781B2

(12) United States Patent
Kayser

(10) Patent No.: US 8,893,781 B2
(45) Date of Patent: Nov. 25, 2014

(54) SEPARATING DEVICE FOR REMOVING SAND AND ROCK PARTICLES

(75) Inventor: Armin Kayser, Buchenberg (DE)

(73) Assignee: ESK Ceramics GmbH & Co. KG, Kempten (DE)

( * ) Notice: Subject to any disclaimer, the term of this patent is extended or adjusted under 35 U.S.C. 154(b) by 771 days.

(21) Appl. No.: 13/129,287

(22) PCT Filed: Nov. 10, 2009

(86) PCT No.: PCT/EP2009/008021
§ 371 (c)(1),
(2), (4) Date: May 13, 2011

(87) PCT Pub. No.: WO2010/057591
PCT Pub. Date: May 27, 2010

(65) Prior Publication Data

US 2011/0220347 A1 Sep. 15, 2011

(30) Foreign Application Priority Data

Nov. 18, 2008 (DE) ..... 10 2008 057 894

(51) Int. Cl.
*E21B 43/08* (2006.01)

(52) U.S. Cl.
CPC ..... *E21B 43/086* (2013.01)
USPC ..... 166/235; 166/227; 166/278

(58) Field of Classification Search
CPC ..... B01D 29/15; B01D 29/46; E21B 43/08; E21B 43/086; E21B 43/088; E03B 3/18
USPC ..... 166/244.1, 230, 235, 227, 157, 278
See application file for complete search history.

(56) References Cited

U.S. PATENT DOCUMENTS

| | | | | |
|---|---|---|---|---|
| 1,533,747 | A * | 4/1925 | Lough | 166/235 |
| 1,705,848 | A * | 3/1929 | Austin | 166/235 |
| 1,709,222 | A * | 4/1929 | Lawlor et al. | 166/235 |
| 1,995,850 | A * | 3/1935 | Harter | 166/235 |

(Continued)

FOREIGN PATENT DOCUMENTS

| | | |
|---|---|---|
| BE | 903 486 A1 | 2/1986 |
| BE | 903486 | 2/1986 |

(Continued)

OTHER PUBLICATIONS

International Search Report for International Application No. PCT/EP2009/008021, with a mailing date of Apr. 26, 2010.

*Primary Examiner* — Daniel P Stephenson
(74) *Attorney, Agent, or Firm* — Nath, Goldberg & Meyer; Jerald L. Meyer; Katelyn J. Bernier

(57) ABSTRACT

Provided herein is a separating device for removing sand and rock particles in the extraction of liquids or gases from wells drilled in rock having a plurality of brittle-hard annular discs stacked one on top of another and axially braced by a supporting structure. The annular discs have at least three spacers uniformly distributed over the circumference on their upper side. The discs are stacked on each other such that the spacers lie one over another and a separating gap with a height of 0.05-1 mm, preferably 0.2-0.5 mm, is present between each of the discs. Similarly, another embodiment of the separating device has a plurality of brittle-hard bush-shaped elements with slits formed therein.

19 Claims, 5 Drawing Sheets

(56) References Cited

U.S. PATENT DOCUMENTS

| | | | | | |
|---|---|---|---|---|---|
| 2,250,871 | A | * | 7/1941 | Lumbert | 166/235 |
| 2,314,477 | A | * | 3/1943 | Bodey, Jr. | 166/234 |
| 2,646,126 | A | | 7/1953 | Goodner | |
| 2,746,552 | A | * | 5/1956 | Grospas | 166/235 |
| 3,009,519 | A | * | 11/1961 | Brown | 166/235 |
| 3,568,842 | A | * | 3/1971 | Bozek | 210/307 |
| 3,789,924 | A | | 2/1974 | Aaltonen et al. | |
| 3,822,744 | A | | 7/1974 | Reijonen et al. | |
| 4,102,395 | A | * | 7/1978 | Robinson | 166/231 |
| 4,267,045 | A | * | 5/1981 | Hoof | 210/322 |
| 4,752,394 | A | * | 6/1988 | McKenzie et al. | 210/488 |
| 4,753,731 | A | * | 6/1988 | Drori | 210/492 |
| 5,122,271 | A | * | 6/1992 | Simon et al. | 210/314 |
| 5,249,626 | A | * | 10/1993 | Gibbins | 166/235 |
| D365,139 | S | * | 12/1995 | Gibbins | D23/209 |
| 5,624,560 | A | | 4/1997 | Voll et al. | |
| 6,769,484 | B2 | * | 8/2004 | Longmore | 166/207 |
| 6,772,837 | B2 | | 8/2004 | Dusterhoft et al. | |
| 8,196,653 | B2 | * | 6/2012 | Fripp et al. | 166/235 |
| 8,302,681 | B2 | * | 11/2012 | Fripp et al. | 166/235 |
| 8,662,167 | B2 | * | 3/2014 | Wildhack et al. | 166/244.1 |
| 2004/0050217 | A1 | | 3/2004 | Heijnen et al. | |
| 2011/0220347 | A1 | * | 9/2011 | Kayser | 166/235 |
| 2012/0018146 | A1 | * | 1/2012 | Wildhack et al. | 166/244.1 |

FOREIGN PATENT DOCUMENTS

| | | | |
|---|---|---|---|
| CN | 201031672 | | 3/2008 |
| DE | 930331 | | 7/1955 |
| DE | 2 016 383 | A1 | 5/1971 |
| DE | 2016383 | | 5/1971 |
| DE | 2 222 282 | A1 | 11/1972 |
| DE | 2225377 | | 12/1972 |
| DE | 2 246 747 | A1 | 4/1973 |
| DE | 2246747 | | 4/1973 |
| DE | 39 20 098 | A1 | 3/1990 |
| DE | 3920098 | | 3/1990 |
| DE | 93 03 331 | U1 | 7/1994 |
| GB | 1 385 193 | A | 2/1975 |
| GB | 2 217 626 | A | 11/1989 |
| GB | 2217626 | A | 11/1989 |
| WO | 2008/080402 | A1 | 7/2008 |

* cited by examiner

Y
2
4
B-B (1:1)

A
B
3
11
1

A-A (1:1)
X
2
4

X (10:1)
6
6
R

Y (5:1)
3

1
2
3
11
3
3

Fig. 2a
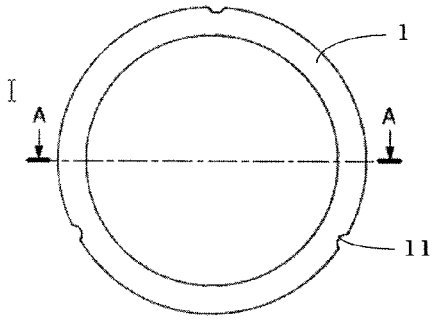
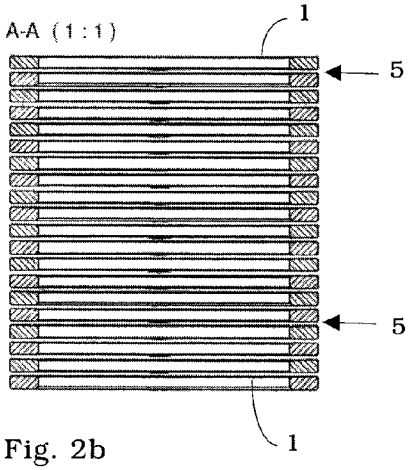
Fig. 2b
Fig. 2c
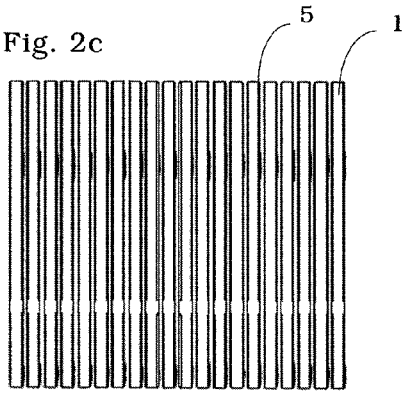
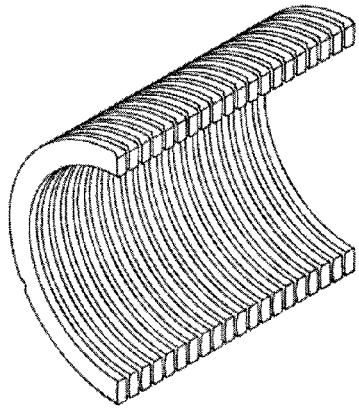
Fig. 2d

SEPARATING DEVICE FOR REMOVING SAND AND ROCK PARTICLES

This is a National Phase Application filed under 35 U.S.C. §371 as a national stage of PCT/EP2009/008021, filed on Nov. 10, 2009, an application claiming the benefit under 35 U.S.C. §119 of German Patent Application No. 10 2008 057 894.0, filed on Nov. 18, 2008, the content of each of which is hereby incorporated by reference in its entirety.

FIELD OF THE INVENTION

The invention relates to novel separating devices with the aid of which sand and rock particles can be removed in a process for the extraction of liquids or gases from wells drilled in rock, and consequently the liquids or gases can be extracted effectively.

BACKGROUND OF THE INVENTION

In the extraction of liquids and gases from wells drilled in rock, there is in principle the problem of flushing out fine sand and rock particles that have to be separated already in the well from the medium that is to be extracted. This problem occurs in particular in the extraction of mineral oil and natural gas, but also in the extraction of drinking water and in the exploitation of ground heat.

PRIOR ART

This removal is conventionally achieved for example by means of metal slotted hole screens, which in various configurations take the form of a slotted metal sheet, woven wire mesh or wire winding. A solution with a woven wire mesh is described in U.S. Pat. No. 5,624,560. These screens are also carried by a metal supporting structure to remain mechanically stable. A major disadvantage of this type of construction is its low resistance to wear. The abrasive rock particles cause great wear.

In US 2004/005 0217 A1 and WO 2008/080402 A1, solutions in which separating devices of porous permeable materials are used instead of the metal slotted hole screens are described. The porous filter materials of US 2004/005 0217 A1 may be metallic, ceramic or organic; in WO 2008/080402 A1, porous ceramic materials are used.

One problem of the solutions described in these two documents is that, on account of their low fracture toughnesses, filters of porous ceramic materials tend to fracture as a result of flexural loading. The ultimate bending strength is generally well below 30% of that of the corresponding solid material and is therefore not sufficient for the mechanical loads under the operating conditions in wells drilled in rock.

A further problem is that the abrasion resistance of porous ceramic materials is much less than that of solid ceramic materials.

Furthermore, the solutions described in US 2004/005 0217 A1 and WO 2008/080402 A1 are disadvantageous in that very rapid clogging of the free screen area occurs. On account of this problem when using porous ceramic materials for filter applications, filter membranes in stationary applications are usually operated with cyclical cleaning by flushing under counterpressure. Since operation with cyclical counterpressure has adverse effects on the output, it should be arranged that the flushing intervals can be as far apart in time as possible.

OBJECT OF THE INVENTION

While overcoming the disadvantages of the prior art, the invention is based on the object of providing a separating device for removing sand and rock particles in the extraction of liquids or gases from wells drilled in rock, which has better wear or abrasion resistance and a lower tendency to fracture than the separating devices known in the prior art, and which moreover is corrosion-resistant to acids and bases and with which rapid clogging of the free filter area does not occur.

SUMMARY OF THE INVENTION

The above object is achieved according to the invention by the separating devices and methods of the using the same described herein. Advantageous and particularly expedient refinements of the subject matter of the application are specified in the subclaims.

According to a first embodiment, the subject matter of the invention is consequently a separating device for removing sand and rock particles in the extraction of liquids or gases from wells drilled in rock, comprising a plurality of annular discs of a brittle-hard material stacked one on top of the other and axially braced by means of a supporting structure, the discs having on their upper side at least three spacers uniformly distributed over the circular circumference of the discs, the discs being stacked one on top of the other in such a way that the spacers respectively lie one over the other, and that a separating gap with a height of 0.05-1 mm, preferably 0.2-0.5 mm, is present in each case between the individual discs.

According to a second embodiment, the subject matter of the invention is a separating device for removing sand and rock particles in the extraction of liquids or gases from wells drilled in rock, comprising a plurality of bush-shaped elements of a brittle-hard material stacked one on top of the other and axially braced by means of a supporting structure, slits with a slit width of 0.05-1 mm, preferably 0.2-0.5 mm, being formed in the bush-shaped elements.

The subject matter of the invention is similarly the use of the separating devices according to the invention for removing sand and rock particles in a process for extracting liquids or gases from wells drilled in rock.

The separating devices according to the invention show a lower tendency to fracture under flexural loading than the systems described in US 2004/005 0217 A1 and WO 2008/080402 A1.

A further advantage of the separating devices according to the invention is that the use of solid, brittle-hard materials, in particular ceramic materials, brings about the advantages of abrasion and corrosion resistance. The expression "solid" means in connection with the materials according to the invention that, by contrast with the solutions of the prior art, they are not porous, so that the materials used according to the invention themselves do not exhibit any filtering effect. The abrasion and wear resistance and the corrosion resistance of the separating devices according to the invention are consequently much greater than in the case of the devices of the prior art described.

The corrosion resistance of the separating devices according to the invention, in particular with respect to acids, is important, since it may be necessary to flush them clear with acids.

A further advantage of the separating devices according to the invention is that rapid clogging of the free screen areas does not occur. It is therefore not necessary to flush the separating devices according to the invention clear at frequent intervals, as in the case of the solutions known in the aforementioned prior art. It is therefore sufficient to flush the separating devices according to the invention clear at greater time intervals, if required.

Furthermore, the free filter area of the separating device according to the invention is greater than that of conventional filter solutions in the form of wire windings, according for example to WO 2008/080402 A1, which is generally below 10%.

Furthermore, the separating devices according to the invention can be introduced into curved wells, which represents a further advantage over the systems described in US 2004/005 0217 A1 and WO 2008/080402 A1.

BRIEF DESCRIPTION OF THE DRAWINGS

The invention is explained on the basis of the drawings, in which:

FIGS. 2*a*-2*d* schematically show various views of annular discs stacked one on top of the other according to the first embodiment of the invention;

DETAILED DESCRIPTION OF THE INVENTION

In a first embodiment, the separating device according to the invention comprises annular discs which can be produced simply and cost-effectively. The production of these annular discs is possible by means of powder-metallurgical or ceramic processes in automated mass production. The annular discs may be produced by what is known as the net-shape process, in which the annular discs are pressed in near net shape from powders. Complex machining of the annular discs is not required. The deviations in shape and size of the individual annular discs that are to some extent unavoidable in a sintering process are tolerable with a construction of the separating device according to the invention.

Figures 1A, 1B, 1C, 1D, 1E, 1F, 1G:
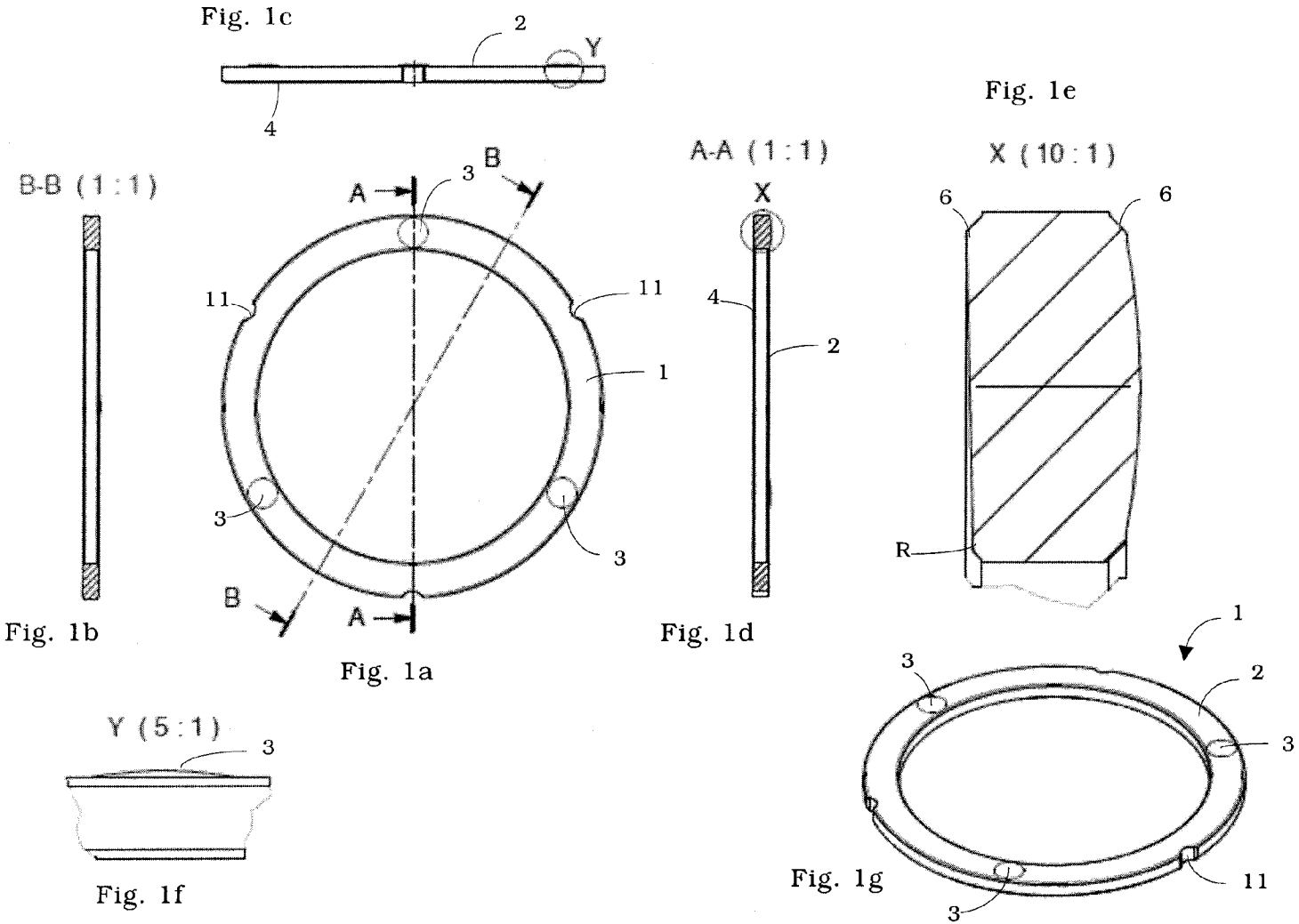
FIGS. 1*a*-1*g* show various views of an annular disc according to a first embodiment of the invention.

FIG. 1*a* shows the basic form of an annular disc 1 according to the invention, which has on its upper side 2 at least three spacers 3 uniformly distributed over the circular circumference of the discs. FIG. 1*b* shows a sectional view along the line B-B in FIG. 1*a*. FIG. 1*c* shows a side view of an annular disc, a spacer being arranged in the region Y. As shown by the enlarged representation of the region Y in FIG. 1*f*, the spacers 3 are preferably given the form of spherical portions. FIG. 1*d* shows a sectional view along the line A-A in FIG. 1*a*. An enlarged representation of the region X through a spacer 3 is shown in FIG. 1*e*.

The upper side 2 of the annular disc 1 may be configured at a right angle to the disc axis or sloping down inwards with a planar or curved surface. An inwardly sloping-down configuration is advantageous with respect to a reduced tendency for the separating device to clog.

The underside 4 (annular base) of the annular discs is preferably sloping down inwards, preferably concavely, as shown in FIG. 1*e*. Here, the annular base is configured with a radius R, while the concave shaping should be understood as applying to the annular base as a whole. The concave shaping allows the individual annular discs easily to avoid structural loading in accordance with the design principle of a spherical axial bearing known per se.

Possible deviations in shape and size can be easily compensated by the concave shaping of the annular base in combination with the three-point contact.

In a preferred embodiment, the outer contours 6 of the annular discs are configured with a bevel, as illustrated in FIG. 1*e*. According to another preferred embodiment, the edges may also be rounded. This represents still better protection of the edges from the edge loading that is critical for brittle-hard materials.

A perspective view of an annular disc according to the invention is shown in FIG. 1*g*.

The inside diameter of the annular discs is preferably less than 90%, more preferably less than 85%, of the outside diameter of the annular discs, and the radial wall thickness of the annular discs is preferably at least 2.5 mm. The thickness of the discs is preferably 2 to 20 mm, more preferably 2 to 10 mm.

According to a preferred embodiment, the annular discs may have a means for preventing twisting, as shown for example by the grooves 11 in FIG. 1*a* and FIG. 1*g*. This ensures that, under axial loading, no flexural moments occur on the annular discs and the axial load always acts via the contact points. Consequently, the annular discs are only under compressive loading, suitable for the material.

To form a separating device according to the invention, the annular discs are stacked axially one on top of the other and axially braced by means of a supporting structure, as shown in FIGS. 2*a*-2*d* and 3*a*-3*c*. FIG. 2*a* shows a plan view of a stack of annular discs 1 according to the invention. FIG. 2*b* shows a sectional view along the line A-A from FIG. 2*a*. When the annular discs are stacked one on top of the other, the spacers 3, arranged at 120° in relation to one another, respectably come to lie one over the other, so that the axial load introduction takes place in the axis of the three spacers. This avoids the edge loads that are critical for brittle-hard materials, and a three-point contact at the desired contact points is achieved even in the case of annular discs with deviations in shape. A separating gap 5 with a height of 0.05-1 mm, preferably 0.2-0.5 mm, forms in each case between the individual discs 1.

FIG. 2*c* schematically shows a side view of a stack of annular discs 1 with the formation of the separating gaps 5. FIG. 2*d* is a perspective representation of a cut-open annular stack.

Figure 3B:
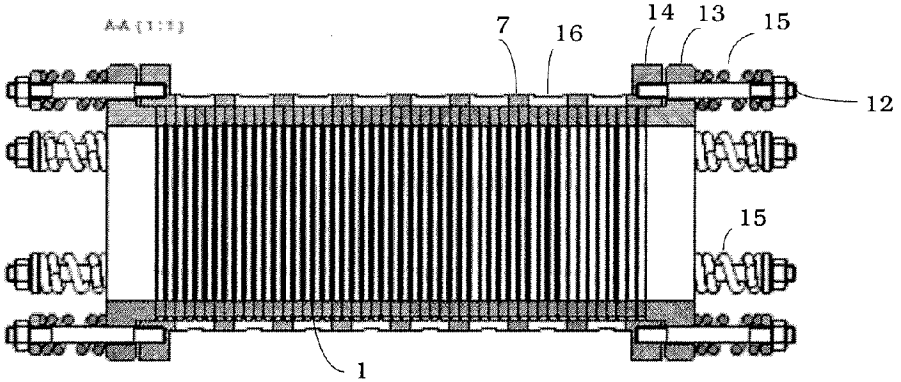
FIGS. 3*a*-3*c* show various views of annular discs stacked one on top of the other and axially braced by means of a supporting structure according to the first embodiment of the invention.
Figure 3C:
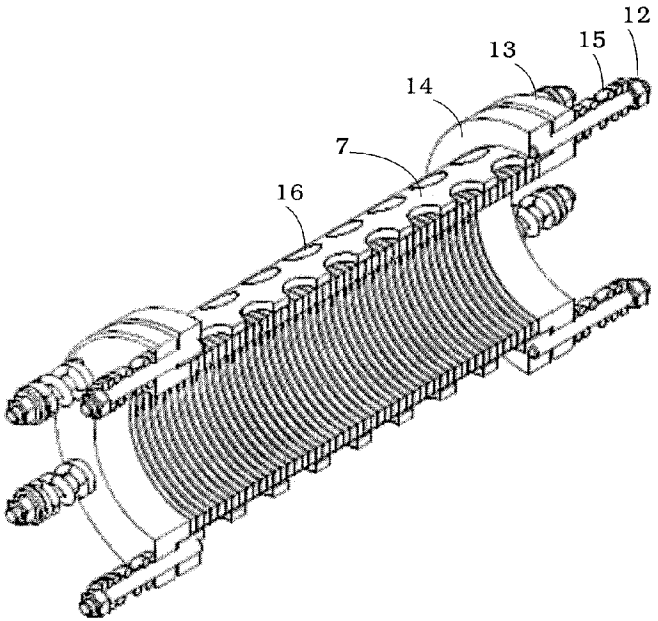
Figure 3A:
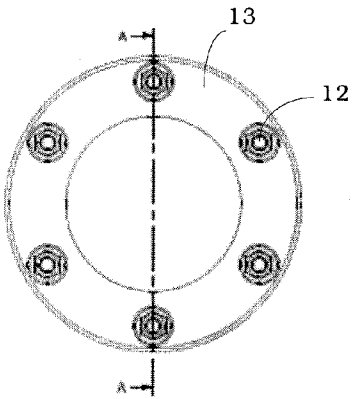

A separating device according to the invention comprising stacked annular discs which are axially braced by means of a supporting structure is shown in FIGS. 3*a*-3*c*. Here, the supporting structure is given the form of a perforated supporting tube 7.

The stack of annular discs may be made any height desired and is limited only by the available length of the supporting structures, such as the supporting tubes 7. Any desired number of these separating devices may be connected to one another and axially braced by conventional screw connections 12 by means of the flange systems 13 and 14 and elastic springs 15 arranged therebetween. FIG. 3*a* shows a plan view of the separating device according to the invention. FIG. 3*b* is a sectional view along the line A-A in FIG. 3*a* and FIG. 3*c* is a perspective view of a cut-open separating device according to FIGS. 3*a* and 3*b*.

In FIGS. 3*a*-3*c*, the supporting tubes 7 are provided on the outside, but they may also be arranged on the inside. The supporting tubes must have passages 16 of any desired shape for the medium to be extracted. The dimensions of the passages 16 must be greater than the filter gaps, in order not to act themselves as filters.

The axial alignment and axial bracing of the annular disc stack is ensured by the supporting tubes. A combination of two or more stack assemblies is made possible by means of flanges 14 provided on the supporting tubes 7. Furthermore, the forces occurring when the separating device is introduced into the well or when it is removed from the well are transferred via the supporting tubes 7. In the case of a supporting tube lying on the outside, the separating device is protected from impact loading caused by rock in the well.

Supporting tubes lying on the outside are exposed to increased wear from the surrounding hard rock particles. However this is much less of a problem than in the case of the separating device itself, since the supporting tube does not have narrow gaps. Moreover, if need be, the supporting tube can be protected from abrasion by conventionally used wear protection layers.

Furthermore, the supporting tubes may be configured with or without a gap in relation to the annular stack. A configuration with a gap allows better utilization of the filter area and better flow around the disc stack.

The supporting tubes 7 brace the disc stack by means of spring elements 15, and thus avoid widening of the filter gap 5 even during introduction into curved wells. The spring elements may be formed, for example, as steel springs or elastomer springs.

The basic function of the separating device according to the invention that is represented by way of example in FIGS. 3*a*-3*c* is that of separating the mixture of liquid or gas with sand or rock particles flowing onto it from the outside from the stream of extracted liquid or gas against it on the inside. All particles that are larger than the separating gap 5 between two neighbouring discs 1 are effectively separated from the stream extracted.

Depending on the size of the radius R (see FIG. 1*e*) on the underside 4 of the annular discs 1, the aforementioned design principle with the spherical axial bearing allows the separating device to be introduced into curved wells.

The dimensions described above of the individual annular discs allow a high mechanical load-bearing capacity during use and good reliability of the process during production. The width of the annular discs has no decisive influence on the separating function. Different dimensions are therefore possible. On the other hand, the height of the annular discs is decisive for the proportion made up by the free filter area. The height of the annular discs is therefore a compromise of mechanical load-bearing capacity and maximum output. It should be adapted to the strength properties of the material and the loading. The radius of the spherical axial bearing is preferably 5 to 50 times, more preferably 10 to 40 times, the outside diameter of the annular discs.

The radius of the spacers given the form of spherical portions depends on the desired separating gap and the width of the annular discs and, for the purposes of structural design, is obtained from both values. Typical separating gaps have a height between 0.2 and 0.5 mm and are based on the grain size of the rock sand to be removed and the maximum permissible particle size in the product stream. The dimensioning of the separating gap corresponds to the maximum permissible particle size in the stream extracted.

In an actual design example, the free filter area in the case of an annular disc height of altogether 3 mm and a gap height of 0.4 mm is 13%. With correspondingly lower annular disc heights, the proportion made up by the free area can be increased still further. The maximum proportion that can be made up by the free area is limited only by the mechanical load-bearing capacity of the annular discs. This is in turn dependent on the supporting structure and the strength of the material.

According to a second embodiment, the separating device according to the invention comprises a plurality of bush-shaped elements stacked one on top of the other and axially braced by means of a supporting structure, in which slits are provided by machining. Here, the slits may be arranged radially and/or axially in relation to the bush axis.

Figure 4A:
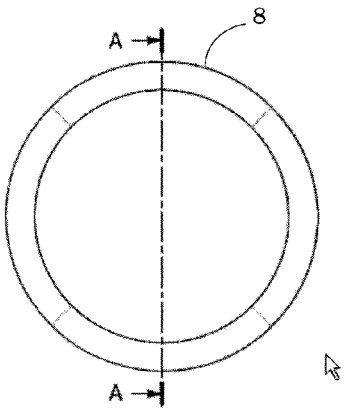
FIGS. 4*a*-4*c* show various views of a bush-shaped, radially slit element according to a second embodiment of the invention.
Figure 4B:
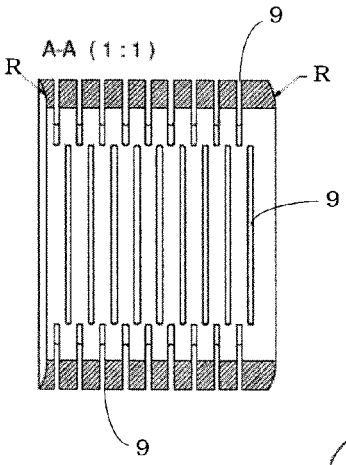
Figure 4C:
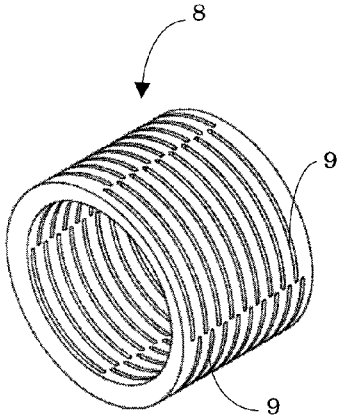

FIGS. 4*a*-4*c* show an embodiment in which the slits 9 are arranged radially in relation to the bush axis. FIG. 4*a* shows the plan view of a bush-shaped element 8. FIG. 4*b* shows a sectional view along the line A-A from FIG. 4*a* of the bush-shaped element 8. FIG. 4*c* shows a perspective view of the bush-shaped element 8. As can be seen from these representations, in the case of this embodiment individual rows of slits 9 are arranged offset in relation to one another.

Figure 5A:
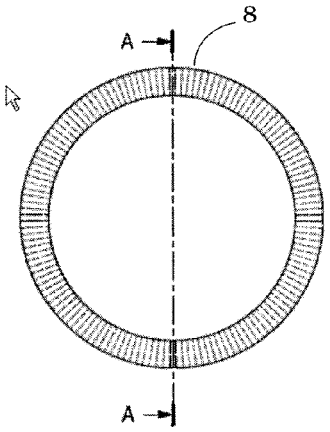
FIGS. 5*a*-5*c* show various views of a bush-shaped, axially slit element according to the second embodiment of the invention.
Figure 5B:
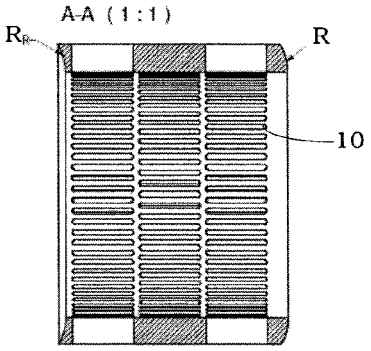
Figure 5C:
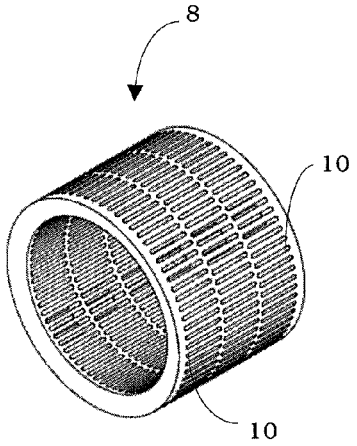

FIGS. 5*a* to 5*c* show a different embodiment of the bush-shaped element 8, in which the slits 10 are arranged axially in relation to the bush axis. FIG. 5*a* shows the plan view of such a bush-shaped element 8. FIG. 5*b* shows a sectional view along the line A-A from FIG. 5*a* of the bush-shaped element 8 and FIG. 5*c* shows an oblique view of the bush-shaped element 8. As can be seen, in the case of this embodiment three rows of axial slits 10, which are spaced apart from one another, are arranged around the circular circumference of the bush.

Suitable machining methods for introducing the slits are, for example, multi-wire sawing or wafer sawing. By analogy with the height of the separating gap in the case of the first embodiment of the invention, the axial and/or radial slits have a width of 0.05-1 mm, preferably 0.2-0.5 mm, slit widths of less than 0.4 mm being further preferred for holding back sands.

Corresponding to the construction in the case of the first embodiment of the separating device according to the invention, the bush-shaped elements are axially guided and braced by supporting tubes lying on the inside or outside. They can consequently be arranged in just the same way to give stacks of any desired height.

To allow introduction into curved wells, preferably one bush end face is concavely shaped, the other convexly shaped, in order to allow the stack of bush-shaped elements to be able to move in an angular manner on the principle of a spherical axial bearing. As shown in FIG. 4*b* and FIG. 5*b*, the radius R is preferably 5 to 50 times, more preferably 10 to 40 times, the outside diameter of the bush-shaped elements 8.

The height of the bush is based on the height that can be produced cost-effectively in a shaping process. In the case of an actual exemplary embodiment, the height is, for example, 80 mm. Such a height can be pressed in a reliable process with customary pressing powders and axial pressing.

Spacers are not required in the case of the bush-shaped elements, since the slits that are introduced already provide the screening effect. However, the design may be identical to that in the case of the first embodiment with respect to spacers and a means for preventing twisting.

The construction with bush-shaped elements is advantageous in comparison with a construction with annular discs in that a smaller number of components is necessary to provide a separating device according to the invention. However, the greater strength of the bushes in principle in comparison with the annular discs is reduced somewhat by the slits that are necessary for a large free filter area.

In a way similar to in the case of the annular discs, the free filter area in the case of the bush-shaped elements is a compromise between the mechanical load-bearing capacity of the bushes and the maximum free filter area. With the same mechanical load-bearing capacity, the maximum free filter area in the case of the first embodiment with annular discs is greater than in the case of the second embodiment with bush-shaped elements.

The inside diameter of the bush-shaped elements is preferably less than 90%, more preferably less than 85%, of the outside diameter of the bush-shaped elements and the radial wall thickness of the bush-shaped elements is preferably at least 2.5 mm.

The outside diameter both of the annular discs in the case of the first embodiment and of the bush-shaped elements in the case of the second embodiment is preferably 50-200 mm.

The mechanical loads of the brittle-hard annular discs and of the bush-shaped elements can be reduced further if a film of plastic is arranged between the annular discs or the bush-shaped elements as an intermediate ring and/or the undersides of the annular discs or the bush-shaped elements are coated with a layer of plastic. This has the effect in particular of reducing high point loads on the brittle-hard annular discs. Consequently, either the height of the annular discs can be reduced or, with the same height, the mechanical load-bearing capacity can be increased.

Suitable plastics may be chosen depending on the temperature and the extraction medium. For a temperature below approximately 100° C. and extraction of water, for example, simple standard plastics, such as polypropylene and polyethylene, may be used. In the case of temperatures up to approximately 140° C., so-called engineering plastics are necessary, such as for example polyamide or polyoxyethylene (POM). In the case of temperatures up to approximately 200° C. and extraction of oil or gas, so-called high-temperature plastics may be used. Materials such as polyetheretherketone (PEEK) or polytetrafluoroethylene (PTFE) still have good resistance even under these conditions. The resistance of the film or coating to abrasive wear can still be significantly increased by reinforcement with ceramic fillers.

The brittle-hard material of the annular discs or of the bush-shaped elements is preferably chosen from oxidic and non-oxidic ceramic materials, mixed ceramics of these materials, ceramic materials with the addition of secondary phases, mixed materials with fractions of ceramic hard materials and with a metallic binding phase, precipitation-hardened casting materials, powder-metallurgical materials with hard material phases formed in situ and long- and/or short-fibre-reinforced ceramic materials.

Examples of oxidic ceramic materials are $Al_2O_3$, $ZrO_2$, mullite, spinel and mixed oxides. Examples of non-oxidic ceramic materials are SiC, $B_4C$, $TiB_2$ and $Si_3N_4$. Ceramic hard materials are, for example, carbides and borides. Examples of mixed materials with a metallic binding phase are WC—Co, TiC—Fe and $TiB_2$—FeNiCr. Examples of hard material phases formed in situ are chromium carbides. An example of fibre-reinforced ceramic materials is C—SiC.

The aforementioned materials are distinguished by being harder than the typically occurring rock particles, that is to say the HV or HRC hardness values of these materials lie above the corresponding values of the surrounding rock. All these materials are at the same time distinguished by having greater brittleness than typical unhardened steel alloys. In this sense, these materials are referred to herein as "brittle-hard".

Materials with a density of at least 90%, more preferably at least 95%, of the theoretical density are preferably used, in order to achieve the highest possible hardness values and high abrasion and corrosion resistances. Sintered silicon carbide (SSiC) or boron carbide are preferably used as the brittle-hard material. These materials are not only abrasion-resistant but also corrosion-resistant to the acids usually used for flushing out the separating device, such as for example HCl.

Particularly suitable are, for example, SSiC materials with a fine-grained microstructure (mean grain size<5 μm), such as are sold for example under the name EKasic® F from ESK Ceramics GmbH & Co. KG. Furthermore, however, coarse-grained SSiC materials may also be used, for example with a bimodal microstructure, preferably 50 to 90% by volume of the grain size distribution consisting of prismatic, platelet-shaped SiC crystallites of a length of from 100 to 1500 μm and 10 to 50% by volume consisting of prismatic, platelet-shaped SiC crystallites of a length of from 5 to less than 100 μm (EKasic® C from ESK Ceramics GmbH & Co. KG).

EXAMPLES

The following example serves for further explanation of the invention.

Example 1

Ceramic Separating Device

In a design example, the outside diameter of the annular filter discs is 100 mm, the inside diameter 80 mm. The height of the annular discs is 3 mm. The radius R of the spherical axial bearing (see FIG. 1*e*) is 2000 mm. The annular gap between two neighbouring annular discs is in each case 0.4 mm. The radius of the three spacers, in the form of spherical portions, on the annular discs is 25 mm. The wall thickness of the metal supporting cage is 3 mm (see FIGS. 3*b* and 3*c*). The free filter area is 13%.

The total length of the separating device in the example is 1000 mm; this corresponds to 294 discs with the aforementioned dimensions in the disc stack.

In the exemplary embodiment, the material SSiC (EKasic® F) is used.

The invention claimed is:

1. A separating device for removing sand and rock particles in an extraction of liquids or gases from wells drilled in rock, comprising a plurality of annular discs (1) of a brittle-hard material stacked one on top of another and axially braced by a supporting structure (7) having springs (15) configured to avoid widening of a gap between the supporting structure and the stack of annular discs, the discs (1) having on their upper side (2) at least three spacers (3) uniformly distributed over a circular circumference of the discs (1), the discs (1) being stacked one on top of the other in such a way that the spacers (3) respectively lie one over the other, and that a separating gap (5) with a height of 0.05-1 mm is present in each case between the individual discs (1).

2. The separating device according to claim 1, wherein the spacers (3) are in the form of spherical portions.

3. The separating device according to claim 1, wherein the upper side (2) of the annular discs (1) are formed at a right angle to the disc axis.

4. The separating device according to claim 1, wherein the upper side (2) of the annular discs (1) are formed sloping down inwards with a planar or curved surface.

5. The separating device according to claim 1, wherein an underside (4) of the annular discs (1) are formed sloping down inwards according to the design principle of a spherical axial bearing.

6. The separating device according to claim 5, wherein the radius of the spherical axial bearing is 5 to 50 times the outside diameter of the annular discs (1).

7. The separating device according to claim 1, wherein the outer edges (6) of the annular discs (1) are bevelled or rounded.

8. The separating device according to claim 1, wherein the inside diameter of the annular discs (1) are less than 90% of the outside diameter of the annular discs (1).

9. The separating device according to claim 1, wherein the radial wall thickness of the annular discs (1) is at least 2.5 mm.

10. The separating device according to claim 1, wherein the thickness of the annular discs (1) is 2 to 20 mm.

11. The separating device according to claim 1, where the annular discs (1) have a means of preventing twisting (11).

12. The separating device according to claim 1, wherein the supporting structure (7) comprises supporting tubes provided on the inside and/or outside.

13. The separating device according to claim 1, wherein the brittle-hard material of the annular discs (1) is chosen from oxidic and non-oxidic ceramic materials, mixed ceramics of these materials, ceramic materials with the addition of secondary phases, mixed materials with fractions of ceramic hard materials and with a metallic binding phase, precipitation-hardened casting materials, powder-metallurgical materials with hard material phases formed in situ and long- and/or short-fibre-reinforced ceramic materials.

14. The separating device according to claim 13, wherein the brittle-hard materials have a density of at least 90% of the theoretical density.

15. The separating device according to claim 13, wherein the brittle-hard material is sintered silicon carbide (SSiC) or boron carbide.

16. The separating device according to claim 1, further comprising a film of plastic arranged between the annular discs (1) as an intermediate ring and/or a plastic coating on an underside of the annular discs.

17. The separating device according to claim 1, wherein the separating gap has a height of 0.2-0.5 mm between the individual discs (1).

18. The separating device according to claim 1, wherein an underside (4) of the annular discs (1) is formed concavely according to the design principle of a spherical axial bearing, wherein a radius of the spherical axial bearing is 10 to 40 times the outside diameter of the annular discs.

19. A method comprising using the separating device according to claim 1 for removing sand and rock particles in a process for extracting liquids or gases from wells drilled in rock.

* * * * *